US007863512B2

(12) United States Patent
Takeda

(10) Patent No.: US 7,863,512 B2
(45) Date of Patent: Jan. 4, 2011

(54) SIGNAL PROCESSING DEVICE, SIGNAL PROCESSING METHOD, AND PROGRAM

(75) Inventor: Haruto Takeda, Tokyo (JP)

(73) Assignee: Sony Corporation, Tokyo (JP)

( * ) Notice: Subject to any disclaimer, the term of this patent is extended or adjusted under 35 U.S.C. 154(b) by 215 days.

(21) Appl. No.: 12/328,236

(22) Filed: Dec. 4, 2008

(65) Prior Publication Data

US 2009/0288546 A1 Nov. 26, 2009

(30) Foreign Application Priority Data

Dec. 7, 2007 (JP) ..... P2007-317722

(51) Int. Cl.
*G10H 7/00* (2006.01)

(52) U.S. Cl. ..... 84/612; 84/601; 84/603

(58) Field of Classification Search ..... 84/612
See application file for complete search history.

(56) References Cited

U.S. PATENT DOCUMENTS

2007/0240558 A1* 10/2007 Seppanen et al. ..... 84/636

FOREIGN PATENT DOCUMENTS

| | | |
|---|---|---|
| JP | 2002-116754 | 4/2002 |
| JP | 2002-287744 | 10/2002 |
| JP | 2004-117530 | 4/2004 |
| JP | 2005-115328 | 4/2005 |
| JP | 2005-274708 | 10/2005 |
| JP | 2006-251712 | 9/2006 |

OTHER PUBLICATIONS

T. Otsuki et al., "Musical Rhythm Recognition Using HMM and Note *N*-gram", Information Processing Society Memoir, vol. 2001, No. 103, Information Processing Society of Japan, pp. 61-68 (2001).
H. Takeda et al., "Joint Estimating of Rhythm and Tempo of Polyphonic MIDI Performance Using Tempo Curve and Hidden Markov Models", Information Processing Society of Japan, vol. 48, No. 1, pp. 237-247 (2007).
Notification of Reasons for Refusal dated Dec. 14, 2009, (Issued on Dec. 22, 2009) in Japanese Application No. 2007-317722.

* cited by examiner

*Primary Examiner*—Elvin G Enad
*Assistant Examiner*—Christopher Uhlir
(74) *Attorney, Agent, or Firm*—Finnegan, Henderson, Farabow, Garrett & Dunner, L.L.P.

(57) ABSTRACT

There is provided a signal processing device for processing an audio signal, the signal processing device including: an onset time detection unit for detecting an onset time based on a level of the audio signal; and a beat length calculation unit for obtaining a beat length Q by: setting an objective function P(Q|X) and an auxiliary function, the objective function P(Q|X) representing a probability that, when an interval X between the onset times is given, the interval X is the beat length Q, the auxiliary function being for inducing an update of both the beat length Q and a tempo Z that results in a monotonous increase of the objective function P(Q|X); and repeating maximization of the auxiliary function to have the auxiliary function converge.

7 Claims, 11 Drawing Sheets

AUTO-CORRELATION FUNCTION OF POWER ENVELOPE OF AUDIO SIGNAL [SECOND]

INITIAL PROBABILITY DISTRIBUTION OF TEMPO [SECOND/BEAT]

PRE-PROCESS
(DETECTION OF ONSET TIME, CALCULATION OF INITIAL PROBABILITY DISTRIBUTION OF TEMPO)

POWER ENVELOPE

DETECTED ONSET TIME

INITIAL PROBABILITY DISTRIBUTION OF TEMPO OBTAINED FROM AUTO-CORRELATION

AFTER ESTIMATION OF BEAT AND TEMPO

SIGNAL PROCESSING DEVICE, SIGNAL PROCESSING METHOD, AND PROGRAM

CROSS REFERENCES TO RELATED APPLICATIONS

The present invention contains subject matter related to Japanese Patent Application JP 2007-317722 filed in the Japan Patent Office on Dec. 7, 2007, the entire contents of which being incorporated herein by reference.

BACKGROUND OF THE INVENTION

The present invention relates to a signal processing device, a signal processing method, and a program.

A method of analyzing the periodicity of an onset time by observing the peak portion and the level of auto-correlation function of an onset start time of an audio signal, and detecting the tempo or the number of crotchet for one minute from the result of analysis is known as a method of detecting the tempo of the audio signal of musical composition and the like. For instance, in a music analyzing technique as described in Japanese Patent Application Laid-Open No. 2005-274708, the level signal in which the time change (hereinafter referred to as "power envelope") of a short time average of the power (signal level) of the audio signal is processed is subjected to Fourier analysis to obtain a power spectrum, the peak of the power spectrum is obtained to detect the tempo, and furthermore, the tempo is corrected to $2^N$ times using a feature quantity obtained from the power spectrum as a post-process.

SUMMARY OF THE INVENTION

However, the music analyzing technique described in Japanese Patent Application Laid-Open No. 2005-274708 obtains a constant tempo over a zone of at least a few dozen seconds such as the tempo of the entire musical composition, and the tempo and the beat in a finer range taking into consideration also the fluctuation of each sound length (e.g., about 0.2 to 2 seconds) may not be estimated. The tempo, rhythm and the like in a finer range to be analyzed are not targeted, and response may not be made to when the tempo changes in the zone of about few dozen seconds (e.g., when tempo gradually becomes faster/slower in one musical composition).

Other tempo estimating method includes a method of obtaining a constant tempo over a constant time length (about few dozen seconds). Such method includes (1) method of obtaining an auto-correlation function of time change of the power of the audio signal. This method basically obtains the tempo through a method similar to the music analyzing technique taking into consideration that the power spectrum is obtained by Fourier transforming the auto-correlation function. The method also includes (2) method of estimating the time length having the highest frequency of appearance at an inter-onset interval as the tempo.

However, in any of the methods described above, the tempo of the music represented by the audio signal is assumed to be constant, and response may not be made to a case where the tempo is not constant. Thus, response may not be made to the audio signal recording live music by a normal human performer where the tempo is not constant, whereby an appropriate beat may not be obtained.

The present invention has been accomplished in view of the above issues, and it is desirable to provide a new and improved signal processing device, a signal processing method, and a program capable of obtaining an appropriate beat from the audio signal even if the tempo of the audio signal changes.

According to an embodiment of the present invention, there is provided a signal processing device for processing an audio signal, the signal processing device including an onset time detection unit for detecting an onset time based on a level of the audio signal; and a beat length calculation unit for obtaining a beat length Q by: setting an objective function P(Q|X) and an auxiliary function, the objective function P(Q|X) representing a probability that, when an interval X between the onset times is given, the interval X is the beat length Q, the auxiliary function being for inducing an update of both the beat length Q and a tempo Z that results in a monotonous increase of the objective function P(Q|X); and repeating maximization of the auxiliary function to have the auxiliary function converge.

The auxiliary function may be set based on an update algorithm of the beat length Q, in which the tempo Z of the audio signal is set as a latent variable, and a logarithm of a posterior probability P(Q|X) is increased monotonously, the posterior probability P(Q|X) being obtained by obtaining an expectation of the latent variable.

The beat length calculation unit may derive the auxiliary function from an EM algorithm.

The beat length calculation unit may obtain an initial probability distribution of the tempo Z of the audio signal based on an auto-correlation function of a temporal change of a power of the audio signal, and uses the initial probability distribution of the tempo Z as an initial value of a probability distribution of the tempo Z contained in the auxiliary function.

A tempo calculation unit for obtaining the tempo Z of the audio signal based on the beat length Q obtained by the beat length calculation unit and the interval X may be further arranged.

According to another embodiment of the present invention, there is provided a signal processing method for processing an audio signal, the signal processing method including the steps of: detecting an onset time based on a level of the audio signal; and obtaining a beat length Q by: setting an objective function P(Q|X) and an auxiliary function, the objective function P(Q|X) representing a probability that, when an interval X between the onset times is given, the interval X is the beat length Q, the auxiliary function being for inducing an update of both the beat length Q and a tempo Z that results in a monotonous increase of the objective function P(Q|X); and repeating maximization of the auxiliary function to have the auxiliary function converge.

According to another embodiment of the present invention, there is provided a program for causing a computer to execute the steps of: detecting an onset time based on a level of the audio signal; and obtaining a beat length Q by: setting an objective function P(Q|X) and an auxiliary function, the objective function P(Q|X) representing a probability that, when an interval X between the onset times is given, the interval X is the beat length Q, the auxiliary function being for inducing an update of both the beat length Q and a tempo Z that results in a monotonous increase of the objective function P(Q|X); and repeating maximization of the auxiliary function to have the auxiliary function converge.

According to the above configuration, an onset time T is detected based on a level of the audio signal, and a beat length Q is obtained by setting an objective function P(Q|X) and an auxiliary function, the objective function P(Q|X) representing a probability that, when an interval X between the onset times is given, the interval X is the beat length Q, the auxiliary function being for inducing an update of both the beat length Q and a tempo Z that results in a monotonous increase of the objective function P(Q|X); and repeating maximization of the auxiliary function to have the auxiliary function converge According to such configuration, the beat can be probabilistically estimated from the audio signal by obtaining the most likely beat length for an inter-onset interval detected from the audio signal.

As described above, an appropriate beat can be obtained from the audio signal even if the tempo of the audio signal changes and the beat fluctuates.

DETAILED DESCRIPTION OF THE PREFERRED EMBODIMENTS

Figure 1:
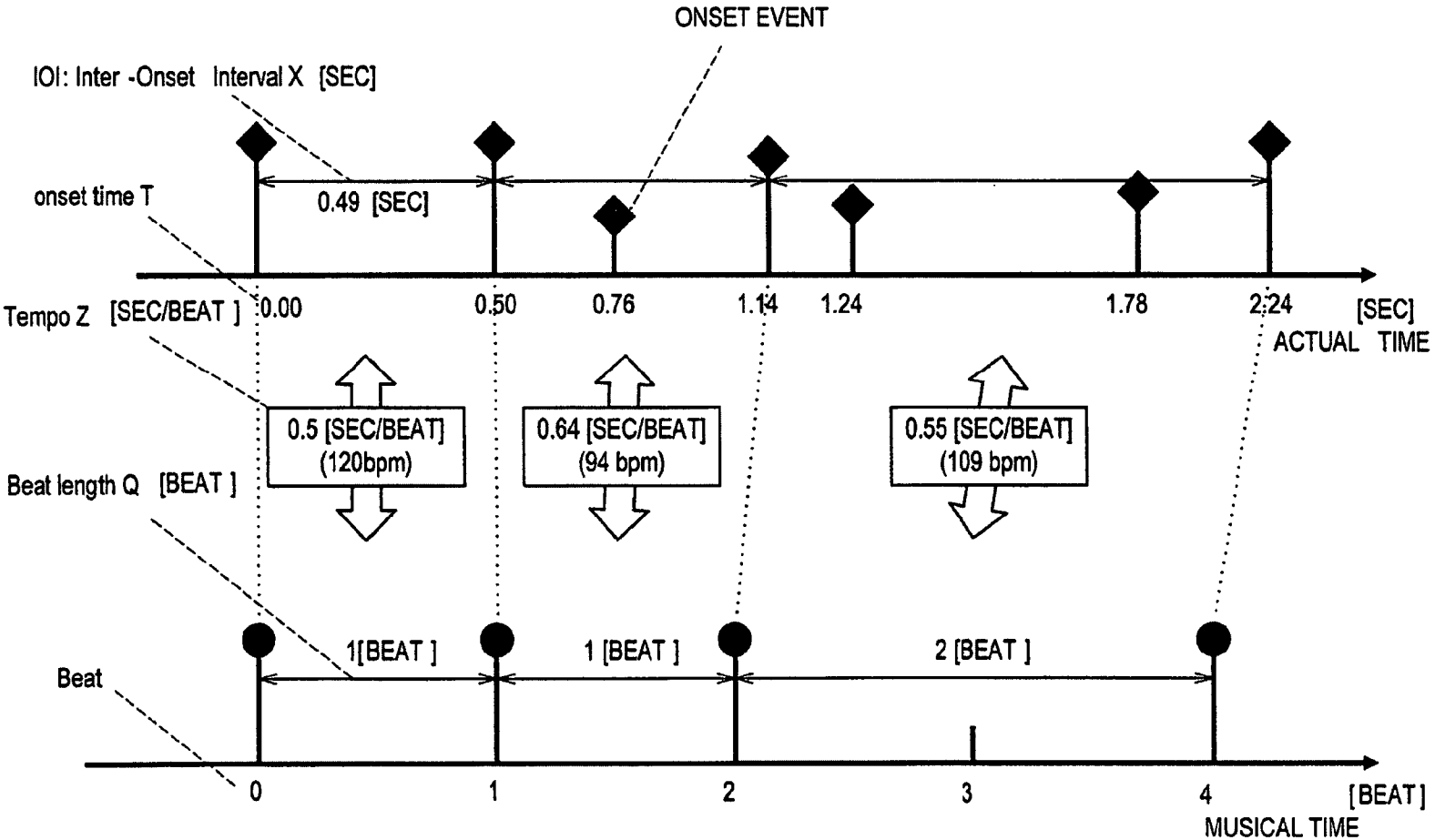
FIG. 1 is an explanatory view showing a relationship between beat and onset time according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

First Embodiment

A signal processing device, a signal processing method, and a program according to a first embodiment of the present invention will be described below.

First, the outline of the present embodiment will be described. The present embodiment performs an analyzing process on an audio signal (refer to audio signal including sound signal etc.) of a music in which the tempo fluctuates, and performs a beat analyzing process of obtaining a time that becomes a dotting point of a beat of the music and a tempo representing the time interval [second/beat] of the beat.

The beat of the music is a feature quantity representing a musical feature of the music (musical composition, sound, and the like) represented by the audio signal, and is used as an important feature quantity to be used to recommend or search for a music. The beat is necessary for pre-processing to perform a complex music analysis and to synchronize the music with robot dance and other multimedia, and thus has a wide range of applications.

The length of the performed sound is determined from two musical time elements, beat and tempo. Therefore, simultaneously determining both the beat and the tempo from the length of the performed sound is an ill-posed problem in which the solution may not be uniquely determined mathematically. Furthermore, it is difficult to accurately obtain the beat when the time that becomes the tempo or the beat fluctuates.

In the present embodiment, beat analysis using a probabilistic model is performed to obtain a beat from the audio signal of music and the like. In the beat analysis, the beat is probabilistically estimated from the audio signal by obtaining the most likely beat for the onset time detected from the audio signal. In other words, in the beat analysis according to the present embodiment, the probability the onset corresponding to the onset time T is the beat in the audio signal is set as an objective function when information related to the onset time of the audio signal is provided, and the beat which maximizes the objective function is obtained. The framework of probabilistically handling the presence of tempo may include information (probability distribution of tempo) representing the sureness of the tempo obtained from the auto-correlation function of the power envelope of the audio signal, and thus robust estimation can be carried out. The tempo of the relevant music can be estimated even if the tempo in the music changes such as even if the tempo gradually becomes faster/slower in one musical composition.

In the probabilistic model according to the present embodiment, the process the sequence of onset time is generated from the beat performed in the music and the tempo that fluctuates in the performance is probabilistically modeled. In the beat estimation using the probabilistic model including tempo as a latent variable, the maximum value (suboptimal solution) of the objective function is obtained probabilistically considering the presence of tempo instead of uniquely defining the value of the tempo which is the latent variable. This is realized using an auxiliary function for performing beat update of increasing the objective function. The auxiliary function (Q function) is an update algorithm of the beat for monotonously increasing the logarithm of a posteriori probability obtained from an expected value of the latent variable, the latent variable being the tempo, and specifically, for example, an EM (Expectation-Maximization) algorithm.

In the beat analysis using such probabilistic model, a plurality of models and the objective functions thereof can be integrated with logical consistency according to the framework having a plurality of elements (onset time, beat, tempo, and the like) as probability.

The terms in the present specification will now be defined with reference to FIG. 1. FIG. 1 is an explanatory view showing a relationship between the beat and the onset time.

"Beat analysis" is a process of obtaining a musical time (unit: "beat") of a music performance represented by an audio signal.

"Onset time" is the time when a tone contained in the audio signal onsets, and is represented by the time on an actual time axis. As shown in FIG. 1, the "onset time" represents the occurrence time of the onset event contained in the audio signal. In the following, the onset time of each tone contained in the audio signal is referred to as t[1], t[2], . . . , t[N], which are collectively referred to as "onset time T" (T=t[1], t[2], . . . , t[N]).

"Inter-Onset Interval (IOI)" is a time interval (unit: [second]) in the actual time of the onset time. As shown in FIG. 1, the "inter-onset interval" represents the time between significant onset events, corresponding to the beat, of the plurality of onset events contained in the audio signal. In the following, the inter-onset interval between individual tones contained in the audio signal is referred to as x[1], x[2], . . . , x[N], which are collectively referred to as "inter-onset interval X (or inter-onset interval X) (X=x[1], x[2], . . . , x[N]).

"Beat" is a musical time specified by the beat(s) counted from a reference time point (e.g., start of performance of music) of the audio signal. This beat represents start time, on the musical time axis, of a tone contained in the audio signal, and is specified by beat which is the unit of the musical time, such as one beat, two beats, . . . .

"Beat length" is an interval of the beat (length between musical time points specified by the beat), and its unit is [beat]. The beat length represents a time interval in the musical time, and corresponds to the "inter-onset interval" on the actual time axis described above. In the following, the beat length between individual tones contained in the audio signal is referred to as q[1], q[2], . . . , q[N], which are collectively referred to as "beat length Q" (Q=q[1], q[2], . . . , q[N]).

"Tempo" is a value (unit: [second/beat]) obtained by dividing the inter-onset interval [second] by the beat length [beat], or a value (unit: [beat/minute]) obtained by dividing the beat length [beat] by the inter-onset interval [second]. The tempo functions as a parameter for converting the inter-onset interval [second] to the beat length [beat]. Although [BPM: Beats per minute] or [beat/minute] is generally used, the former is used in the present embodiment and [second/beat] is used for the unit of tempo. In the following, the tempo at individual tone contained in the audio signal is referred to as z[1], z[2], . . . , z[N], which are collectively referred to as "tempo Z" (Z=z[1], z[2], . . . , z[N]).

Such tempo Z is a parameter representing the relationship between the inter-onset interval (IOI) X and the beat length Q (Z=X/Q). As apparent from the relationship of the inter-onset interval X, the beat length Q, and the tempo Z, the beat length Q generally may not be obtained unless both the inter-onset interval X and the tempo Z are provided. However, it is generally difficult to accurately obtain both the inter-onset interval X and the tempo Z from the audio signal. In the present embodiment, therefore, the onset time T is obtained as a candidate of the inter-onset interval X from the audio signal, and the value of the tempo Z is probabilistically handled without limiting the tempo Z to a predetermined fixed value to enable the estimation of a more robust beat length Q with respect to the time change of the tempo and the fluctuation of the beat.

A configuration of the signal processing device for executing the beat analyzing process will now be described. The signal processing device according to the present embodiment can be applied to various electronic equipments as long as the equipment includes a processor for processing an audio signal, a memory, and the like. As specific examples, the signal processing device may be applied to an information processing device such as a personal computer, a recording and reproducing device such as PDA (Personal Digital Assistant), household game machine, and DVD/HDD recorder, an information consumer electronics such as television receiver, a portable terminal such as portable music player, AV compo, portable game equipment, portable telephone, and PHS, a digital camera, a video camera, an in-vehicle audio equipment, a robot, an electronic musical instrument such as electronic piano, a wireless/wired communication equipment, and the like.

The audio signal content handled by the signal processing device is not only an audio signal contained in an audio content of music (musical composition, sound, etc.), lecture, radio program, and the like, and may be a video content of movie, television program, video program, and the like, and an audio signal contained in game, software, and the like. The audio signal input to the signal processing device may be an audio signal read from various storage devices including a removable storage medium such as music CD, DVD, memory card, and the like, an HDD, and a semiconductor memory, or an audio signal received via a network including public line network such as Internet, telephone line network, satellite communication network, and broadcast communication network, a dedicated line network such as LAN (Local Area Network) and the like.

Figure 2:
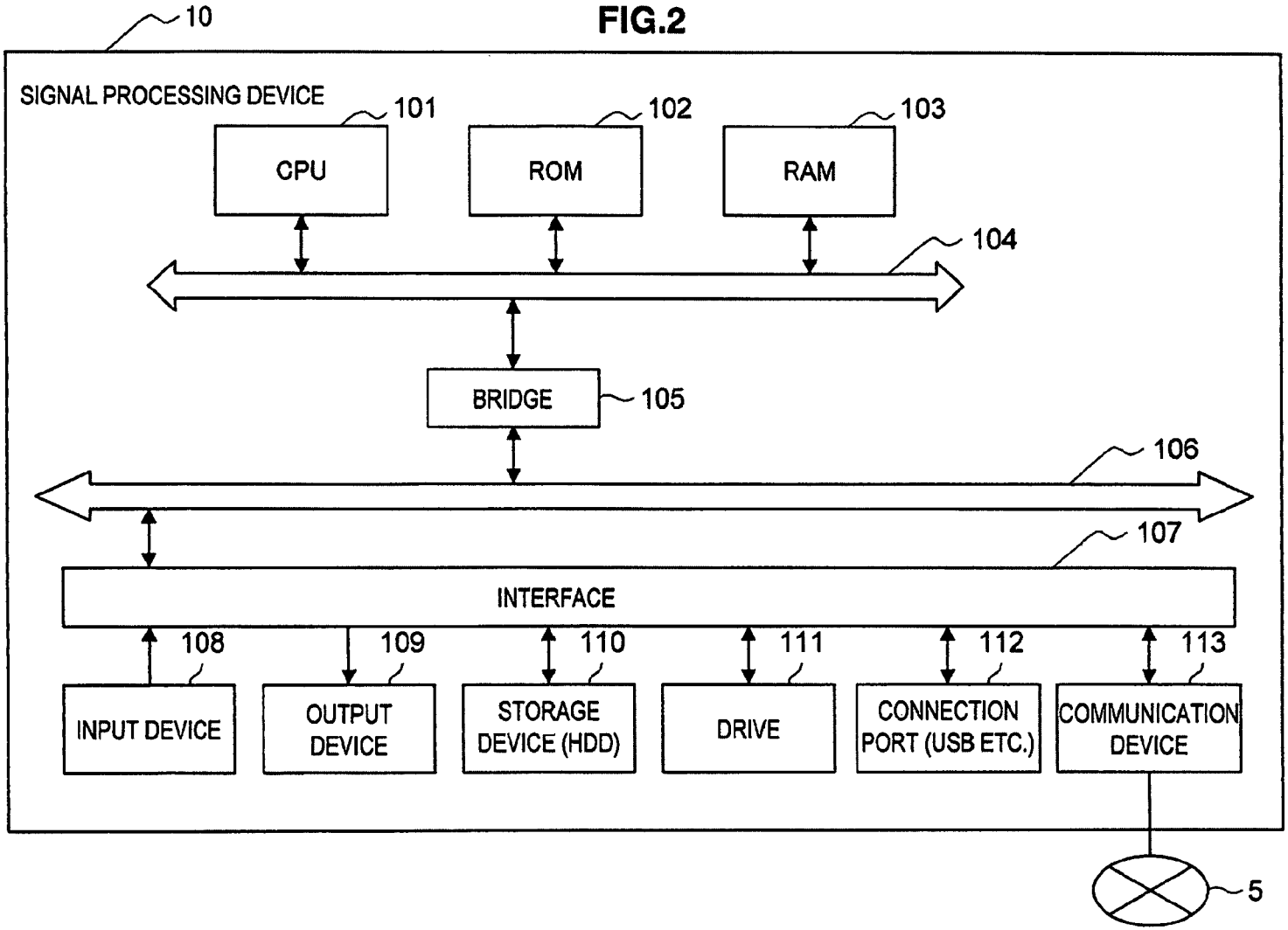
FIG. 2 is a block diagram showing a hardware configuration of a signal processing device according to the embodiment.

A hardware configuration of a signal processing device 10 according to the present embodiment will now be described with reference to FIG. 2. In FIG. 2, an example where a signal processing device 10 is configured to include a personal computer and the like is shown, but the signal processing device according to the present invention is not limited to such example, and may be applied to various electronic equipments.

As shown in FIG. 2, the signal processing device 10 includes a CPU (Central Processing Unit) 101, a ROM (Read Only Memory) 102, a RAM (Random Access Memory) 103, a host bus 104, a bridge 105, an external bus 106, an interface 107, an input device 108, an output device 109, a storage device 110 (e.g., HDD), a drive 111, a connection port 112, and a communication device 113.

The CPU 101 functions as a calculation processing device and a control device, operates according to various programs, and controls each unit of the signal processing device 10. The CPU 101 executes various processes according to a program stored in the ROM 102 or a program loaded from the storage device 110 to the RAM 103. The ROM 102 stores programs, calculation parameters, and the like used by the CPU 101, and also functions as a buffer for alleviating the access from the CPU 101 to the storage device 110. The RAM 103 temporarily stores programs used in the execution of the CPU 101, the parameters appropriately changed in the execution, and the like. These are mutually connected by a host bus 104 configured to include a CPU bus and the like. The host bus 104 is connected to the external bus 106 such as PCI (Peripheral Component Interconnect/Interface) bus by way of the bridge 105.

The input device 108 is configured to include mouse, keyboard, touch panel, button, switch, lever, and the like. The user of the signal processing device 10 operates the input device 108 to input various data to the signal processing device 10 and instruct processing operations. The output device 109 is configured to include a display device such as CRT (Cathode Ray Tube) display device and liquid crystal display (LCD) display, an audio output device such as speaker, and the like.

The storage device 110 is a device for storing various data, and is configured to include HDD (Hard Disk Drive) and the like. The storage device 110 is configured to include a hard disc which is a storage medium and a drive for driving the hard disc, and stores programs to be executed by the CPU 101 and various data. The drive 111 is a drive device for removable media, and is incorporated or externally attached to the signal processing device 10. The drive 111 writes/reads various data with respect to the removable media such as CD, DVD, Blu-Ray disc, and memory card loaded on the signal processing device 10. For instance, the drive 111 reads and reproduces music content recorded on the music CD, the memory card, and the like. The audio signal of the music content is then input to the signal processing device 10.

The connection port 112 is a port (e.g., USB port) for connecting external peripheral equipment, and has a connection terminal of USB, IEEE 1394 and the like. The connection port 112 is connected to the interface 107, and the CPU 101 and the like by way of the external bus 106, the bridge 105, the host bus 104, and the like. The connection port 112 is connected with a removable media with connector such as USB memory, and an external equipment such as portable movie/music player, PDA, and HDD. The audio signal of the music content transferred from the removable media, the external equipment, or the like is input to the signal processing device 10 via the connection port 112.

The communication device 113 is a communication interface for connecting to various networks 5 such as Internet and LAN, where the communication method may be wireless/wired communication. The communication device 113 transmits and receives various data with the external equipment connected by way of the network. For instance, the communication device 113 receives the music content, the movie content, and the like from a content distribution server. The audio signal of the music content received from the outside is then input to the signal processing device 10.

Figure 3:
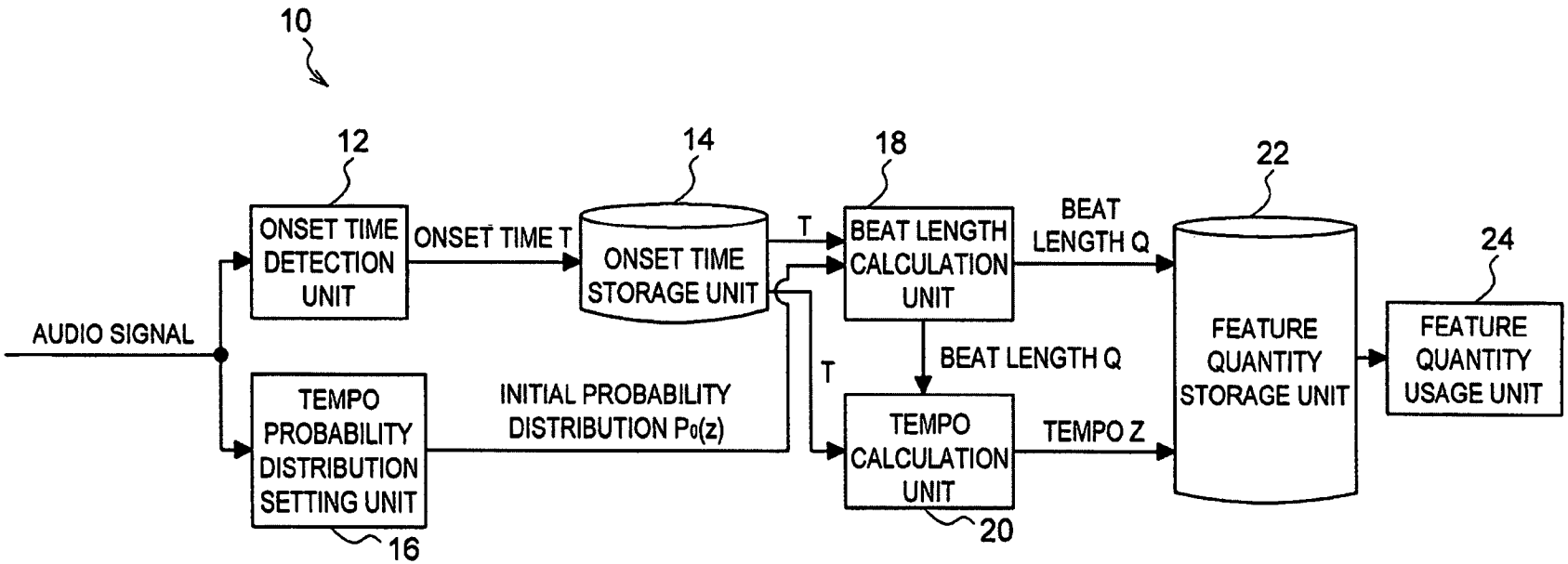
FIG. 3 is a function block diagram showing a configuration of the signal processing device according to the present embodiment.
Figure 4:
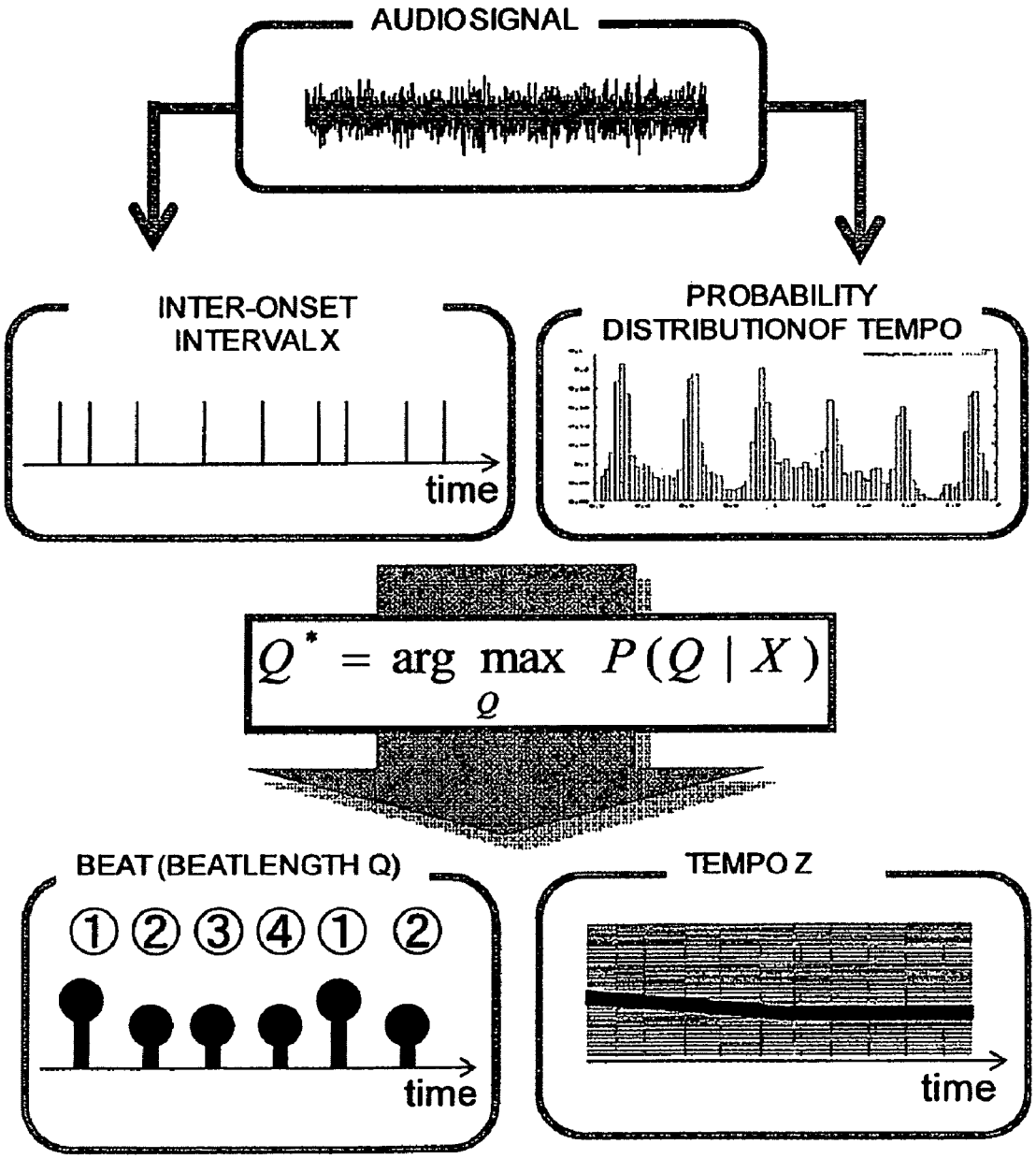
FIG. 4 is an explanatory view showing an outline of a signal processing method executed by the signal processing device according to the present embodiment.
Figure 5:
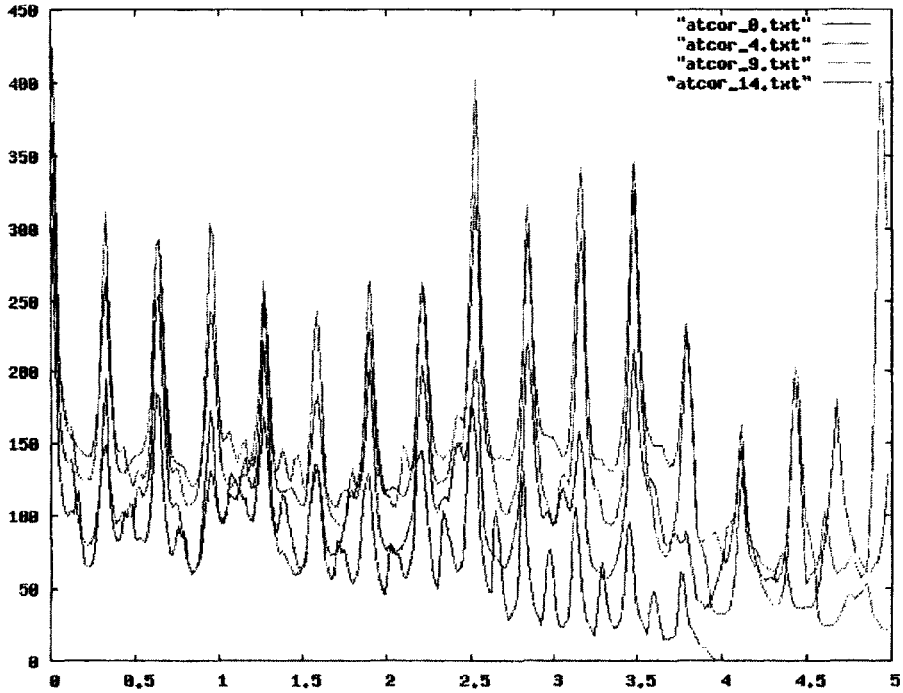
FIG. 5 is an explanatory view showing a relationship between an auto-correlation function of a power envelope of the audio signal and a probability distribution of a tempo according to the present embodiment.
Figure 5:
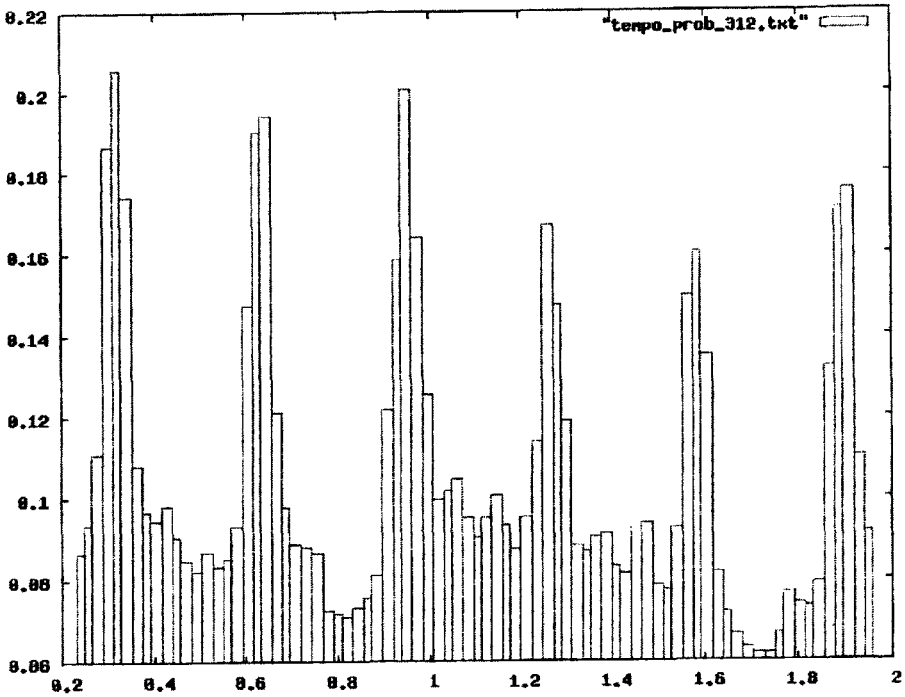

A function configuration of the signal processing device 10 according to the present embodiment will now be described with reference to FIGS. 3 to 5. FIG. 3 is a function block diagram showing a configuration of the signal processing device 10 according to the present embodiment. FIG. 4 is an explanatory view showing an outline of a signal processing method (beat and tempo analyzing method) executed by the signal processing device 10 according to the present embodiment. FIG. 5 is an explanatory view showing a relationship between an auto-correlation function of the power envelope of the audio signal and the probability distribution of the tempo.

As shown in FIG. 3, the signal processing device 10 according to the present embodiment includes an onset time detection unit 12 for detecting an onset time T based on a signal level of the audio signal, an onset time storage unit 14 configured to include a memory such as flash memory and RAM, a tempo probability distribution setting unit 16 for setting an initial probability distribution $P_0(Z)$ of the tempo Z using the auto-correlation function related to the signal level of the audio signal, a beat length calculation unit 18 for calculating the beat length of the music represented by the audio signal based on the information (inter-onset interval X) related to the detected onset time T and the initial probability distribution $P_0(Z)$ of the tempo Z, a tempo calculation unit 20 for calculating the tempo of the music represented by the audio signal based on the estimated beat and the detected inter-onset interval X, a feature quantity storage unit 22 configured to include a memory such as flash memory and RAM, and a feature quantity usage unit 24 for using the feature quantity such as beat and tempo Z.

As shown in FIG. 4, the onset time detection unit 12 analyzes the externally input audio signal, and detects the onset time T of a plurality of tones (onset event) contained in the audio signal. For instance, the onset time detection unit 12 obtains the time change (i.e., power envelope of audio signal) of the power (signal level) of the audio signal, extracts a plurality of peaks contained in the audio signal, and estimates the time immediately before each peak as the onset time T. The onset time detection unit 12 saves the onset time T detected in the above manner in the onset time storage unit 14. The details of the onset time detection process by the onset time detection unit 12 will be hereinafter described (see FIG. 7 etc.).

As shown in FIGS. 4 and 5, the tempo probability distribution setting unit 16 analyzes the signal level of the audio signal to obtain the auto-correlation function of the power envelope of the audio signal. In the auto-correlation function of the power envelope, the frequency having high auto-correlation has a high possibility of being a tempo. Therefore, the tempo probability distribution setting unit 16 calculates the initial probability distribution $P_0(Z)$ of the tempo Z using the auto-correlation function, and sets the initial probability distribution $P_0(Z)$ as the initial value of the probability distribution P(Z) of the tempo Z to be hereinafter described. The details of the initial probability distribution setting process of the tempo Z by the tempo probability distribution setting unit 16 will be hereinafter described (see FIG. 8 and the like).

The beat length calculation unit 18 performs beat analysis using the probabilistic model including the tempo Z as the probability variable, and obtains the beat length Q of the audio signal. As shown in FIG. 4, the beat length calculation unit 18 uses the EM algorithm to probabilistically estimate the most likely beat length Q with respect to the inter-onset interval X of the audio signal. If the beat length Q of each tone (onset event) of the audio signal is obtained, the beat or the musical time of the tone of the audio signal can be obtained from the relevant beat length Q.

In the beat estimation process by the beat length calculating unit 18, the beat length calculation unit 18 obtains the inter-onset interval X by calculating the difference of the plurality of onset times T detected by the onset time detection unit 12. The beat length calculation unit 18 uses the initial probability distribution $P_0(Z)$ of the tempo Z obtained by the tempo probability distribution setting unit 16 to set the objective function P(Q|X) representing the probability the onset corresponding to the inter-onset interval X is the beat of the audio signal, and the auxiliary function (Q function) for guiding the update of the beat length Q for monotonously increasing (monotonously non-decreasing) the objective function P(Q|X). The beat length calculation unit 18 repeats the update of guiding the log likelihood log P(X|Q) to a maximum value using the auxiliary function (Q function) to obtain a sub-optimal solution of the objective function P(Q|X). The EM algorithm includes an E step (Expectation step), and an M step (Maximization step). In the E step, the beat length calculation unit 18 performs an estimation process of the probability distribution P(Z|X,Q) of the tempo Z which is the latent variable, and obtains the auxiliary function (Q function). In the M step, the beat length calculation unit 18 maximizes the auxiliary function (Q function) by Viterbi algorithm and the like. The auxiliary function (Q function) is converged by repeating the E step and the M step, and the beat length Q is obtained from the converged Q function.

The beat length calculation unit 18 saves the beat length Q estimated as above in the feature quantity storage unit 22. The details of the calculation process of the beat (beat length Q) by the beat length calculation unit 18 will be hereinafter described (see FIG. 8 etc.).

The tempo calculation unit 20 calculates the tempo Z based on the beat length Q calculated by the beat length calculation unit 18 and the inter-onset interval X. For instance, the tempo calculating unit 20 divides the inter-onset interval x[second] of each tone contained in the audio signal by the beat length q [beat] of each tone to obtain the tempo z[second/beat] in each tone (z=x/q). Furthermore, the tempo calculation unit 20 saves the beat length Q calculated as above in the feature quantity storage unit 22. The details of the calculation process of the tempo Z by the tempo calculation unit 20 will be hereinafter described (see FIG. 9 etc.).

The feature quantity usage unit 24 uses the feature quantity (beat length Q, tempo Z, or the like) of the audio signal stored in the feature quantity storage unit 22 to provide various applications to the user of the electronic equipment. The method of using the feature quantity such as the beat length Q or the tempo Z extends over a wide range including provision of metadata with respect to the music content, search for music content, recommendation of the music content, organization of musical compositions, synchronization with the robot dance for dancing the robot with the beat of the music, synchronization with the slide show of pictures, automatic scoring, musical analysis, and the like. The feature quantity also includes arbitrary information obtained by calculating and processing the beat itself, the beat length Q, and the tempo Z, in addition to the beat length Q and the tempo Z as long as it is information representing the feature of the music represented by the audio signal.

The function configuration of the signal processing device 10 according to the present embodiment has been described. The onset time detection unit 12, the tempo probability distribution setting unit 16, the beat length calculation unit 18, the tempo calculation unit 20, or the feature quantity usage unit 24 may be partially or entirely configured by software or configured by hardware. When configured by software, the computer program for causing the computer to execute the process of each unit is installed in the signal processing device 10. This program is provided to the signal processing device 10, for example, through an arbitrary storage medium or an arbitrary communication medium.

Figure 6:
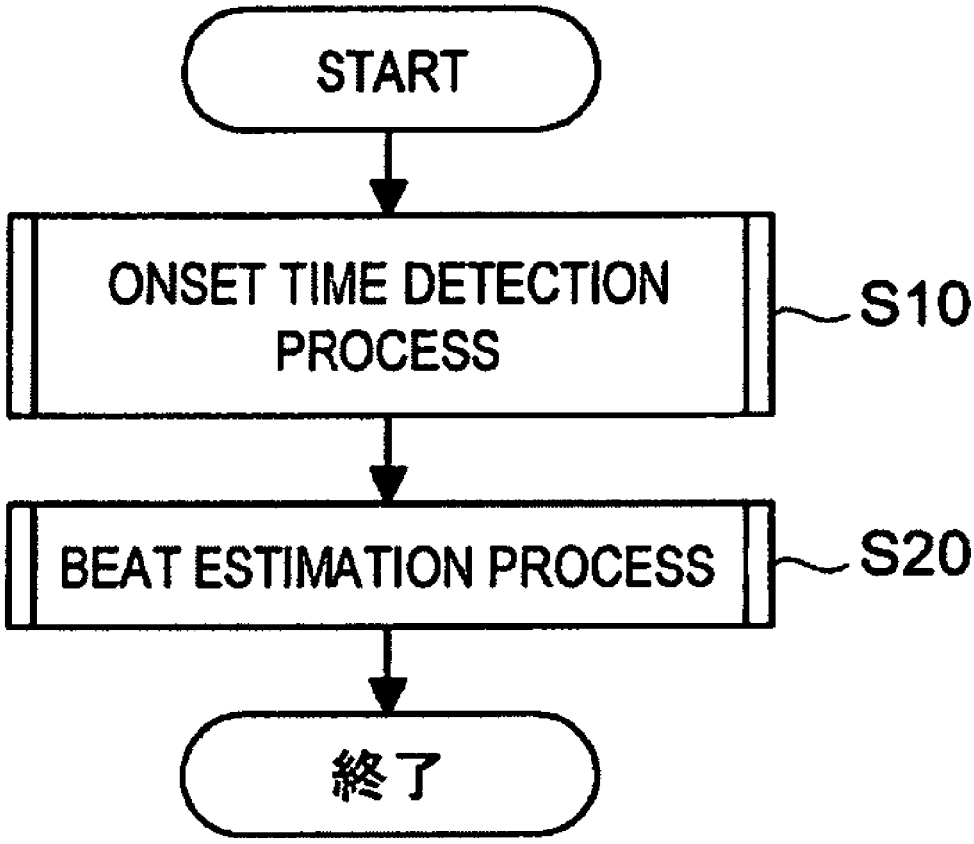
FIG. 6 is a flowchart showing a beat analyzing method according to the present embodiment.

A beat analyzing method, which is one example of the signal processing method, according to the present embodiment will now be described with reference to FIG. 6. FIG. 6 is a flowchart showing the beat analyzing method according to the present embodiment.

As shown in FIG. 6, the beat analyzing method according to the present embodiment includes an onset time detection process (S10) of detecting the onset time T from the audio signal as a pre-process of the beat estimation process, and a beat estimation process (S20) of probabilistically obtaining the beat based on the onset time T obtained in S10.

In the onset time detection process (S10), the audio signal is processed, the onset time T of the music (tone being performed) represented by the audio signal is detected, and the inter-onset interval X is obtained. Various methods have been proposed in the related art as the method of detecting the onset time T. In the beat analyzing method according to the present embodiment, the detection process S10 of the onset time T and the beat estimation process S20 of obtaining the beat from the onset time T are independent processes with the onset time detection process used as the pre-process. Thus, in the beat analyzing method according to the present embodiment, the usage conditions are not limited in principle by the combination with the onset time detection method.

Figure 7:
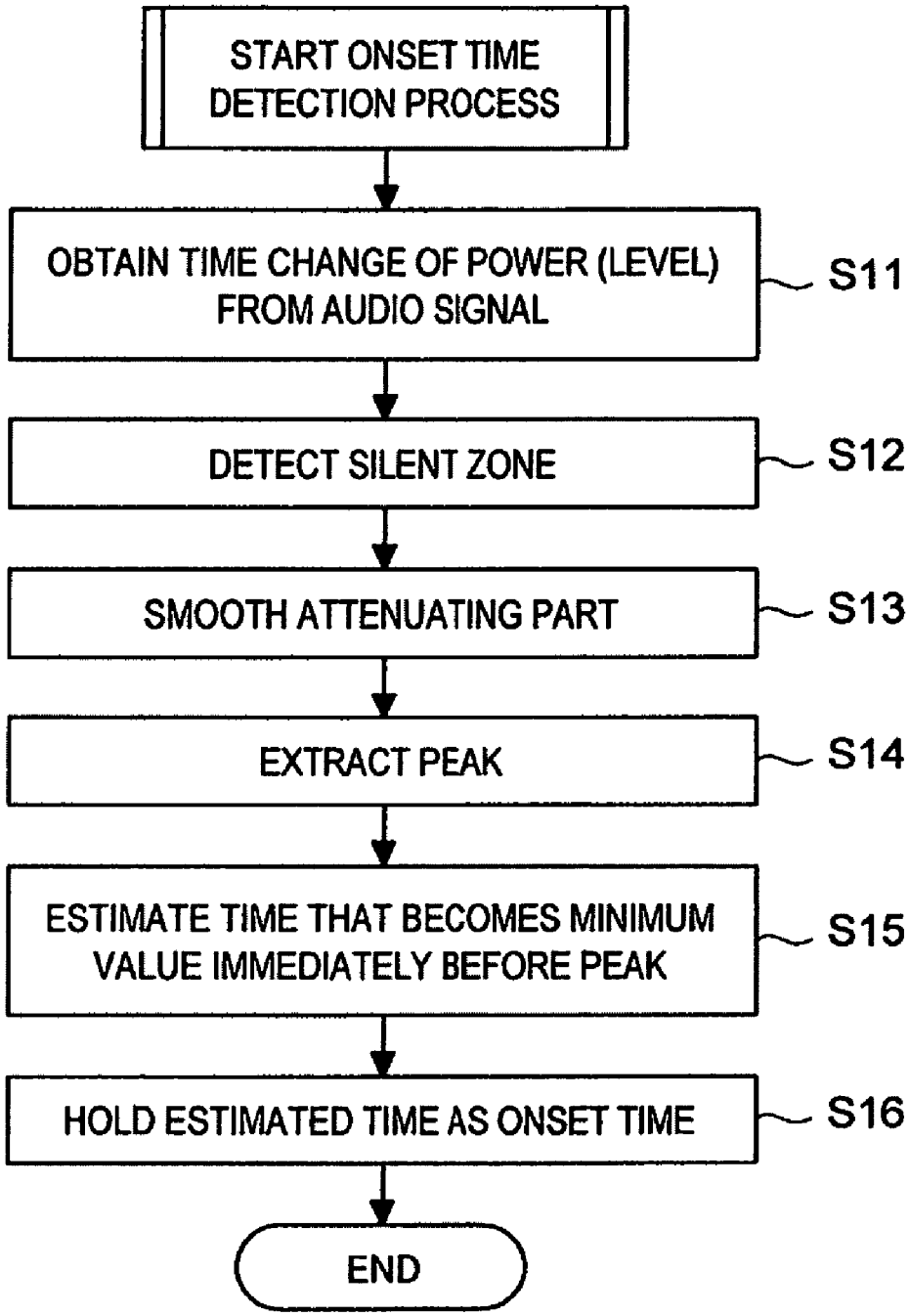
FIG. 7 is a flowchart showing an onset time detection process of FIG. 6.

The specific example of the onset time detection process (S10 of FIG. 6) according to the present embodiment will be described with reference to FIG. 7. FIG. 7 is a flowchart showing an example of the onset time detection process S10 of FIG. 6.

As shown in FIG. 7, in the onset time detection process S10, the onset time detection unit 12 of the signal processing device 10 first obtains the time change (i.e., power envelope) of the power (signal level) of the input audio signal, and extracts the peak of the time change of the power (steps S11 to S13). More specifically, the onset time detection unit 12 calculates the energy for every short amount of time (e.g., about few dozen milliseconds) of the audio signal and generates a level signal representing the time change (i.e., power envelope) of the power of the audio signal for every short amount of time (step S11). The onset time detection unit 12 removes the silent zone from the time change (level signal) in the power of the audio signal (step S12), and smoothes an attenuating part (step S13). Thereafter, the onset time detection unit 12 extracts the peak of the level signal after the processes in S12 and S13 (step S14), and estimates the time at which the level signal immediately before the peak becomes a minimum value as the onset time T (=t[1], t[2], . . . , t[N]) (step S15). The onset time detection unit 12 then holds the onset time T estimated in S15 in the onset time storage unit 14 (step S16).

The onset time detection process has been described above. The onset time T detected above may include the onset time of the onset event (tone) corresponding to the beat, but generally, the onset time of the onset event not corresponding to the beat may be detected or the onset time may not be detected at the time the beat is to originally exist. Therefore, it is preferable to select an appropriate onset time T corresponding to the beat from the detected onset times T, and to complement the onset time T to the time the beat is to originally exist. Thus, in the beat estimation process described below, the beat analysis using probabilistic model is performed to convert the inter-onset interval X (unit: [second]) obtained from the detected onset time T to an appropriate beat length (unit: [beat]).

The principle of the beat analysis using the probabilistic model according to the present embodiment will be described. First, the difference among the plurality of onset times T (=t[0], t[1], . . . , t[N]) detected in the onset time detection process (S10) is calculated to obtain the inter-onset interval (IOI) X (=x[1], x[2], . . . , x[N]). For instance, the difference between the onset time t[10] and the onset time t[1] becomes the inter-onset interval x[1]. The time series (unit: [beat]) of the beat length q corresponding to the inter-onset interval x[1], . . . , x[N] (unit: [second]) is obtained including the possibility of the presence of the onset time not corresponding to the beat and the absence of the onset time corresponding to the beat.

Taking various fluctuations including the fluctuation of the tempo Z, the beat pattern, and the performance probabilistically into consideration, assuming the problem of obtaining the beat length Q (=q[1], . . . , q[N]) from the inter-onset interval X (=x[1], . . . , x[N]) obtained from the audio signal as the problem of obtaining the most likely Q with respect to the detected X, this can be formulized to the following equation (1). Since $P(Q|X) \propto P(X|Q)P(Q)$, modeling is performed to provide $P(X|Q)P(Q)$, where Q can be obtained if the maximizing method thereof can be obtained.

$$\hat{Q} = \arg\max_{Q} P(Q \mid X) = \arg\max_{Q} P(X \mid Q) \cdot P(Q) \tag{1}$$

P(Q|X): a posteriori probability

P(X|Q): likelihood

P(Q): a priori probability

This estimation method is referred to as maximum a posteriori probability (MAP), where $P(Q|X) \propto P(X|Q)P(Q)$ is referred to as the posteriori probability. In the beat analysis according to the present embodiment, the modeling for obtaining the beat length Q from the inter-onset interval X and the calculation method for actually obtaining the beat using the relevant model will be described below.

Here, another musical element called tempo z[n] at which the beat is performed exists in each beat length q[n], and thus the relationship of the inter-onset interval (sound length) x[n] and the beat length q[n] may not be considered without considering the tempo z. That is, the relationship between the beat length Q and the inter-onset interval X may not be modeled unless consideration is made with the model including tempo.

Although P(X,Z|Q) is being modeled, but it is P(X|Q)P(Q) that is to be obtained in the present embodiment. (To simplify the description below, "P(Q)" of "P(X|Q)P(Q)" is temporarily omitted. The P(Q) will be handled later. In this case, maximum likelihood (ML) estimation is performed instead of the MAP estimation.) In the beat estimation method according to the present embodiment, the EM algorithm is applied as a method of obtaining the Q that maximizes P(X|Q) using the model providing P(X,Z|Q). The EM algorithm is known as an estimation method of the likelihood function P(X|Q), but this method can be used even for the probabilistic model including the priori probability P(Q), where the present method applies the EM algorithm when including priori knowledge P(Q).

In the EM algorithm, the expected value of log P(X,Z|Q) is obtained in the following relational expression (2) using the probability distribution P(Z|X,Q) of the tempo Z (latent variable) of when a certain beat length Q is assumed, where it is mathematically proven that the expected value of the difference of the log likelihood "log P(X|Q)−log P(X|Q)" of when the beat length is updated from Q to Q' is positive (non-negative) when Q' maximizing the auxiliary function (Q function) is obtained. The Q function or the auxiliary function is expressed with equation (3). The EM algorithm monotonously increases the log likelihood log P(X|Q) to the maximum value by repeating the E step (Expectation step) of obtaining the Q function and the M step (Maximization step) of maximizing the Q function.

$$\log P(X|Q')=\log P(X,Z|Q')-\log P(Z|X,Q') \tag{2}$$

$$G(Q,Q')=\int P(Z|X,Q)\cdot\log P(X,Z|Q')dz \tag{3}$$

In the present embodiment, such EM algorithm is applied to the beat analysis. The specific calculation method of the model probabilistically providing the relationship between the tempo Z, the beat length Q, and the inter-onset interval X giving P(X,Z|Q), the Q function when the model is used, and the EM algorithm when the Q function is used will be described below.

In probabilistic modeling, the fluctuation of the tempo Z is first probabilistically modeled. The tempo Z has a characteristic of gradually fluctuating, where modeling can be carried out such that the probability the tempo Z becomes a constant value is high according to such characteristic. For instance, the fluctuation of the tempo Z can be modeled as a Markov process complying with the probability distribution p(z[n]|z[n−1]) (e.g., normal distribution and lognormal distribution) having 0 as the center. Here, z[n] corresponds to the tempo at the $n^{th}$ onset time t[n].

The fluctuation of the inter-onset interval X (=x[1], x[2], . . . , x[N]) is the modeled. The fluctuation of the inter-onset interval x[n] provides a probability dependent on the tempo z[n] and the beat length q[n]. In an ideal case where the tempo is constant and there are no fluctuation in the onset time T and error in detection, the inter-onset interval (sound length) x[n] (unit: [second]) is equal to the product of the tempo z[n] (unit: [second/beat]) and the beat length q[n] (unit: [beat]) (x[n]=z[n]·q[n]). However, since fluctuation in the tempo Z by the performance expression of the performer and the onset time T, and the detection error of the onset time are actually included, they are generally not equal. The error in this case can be probabilistically considered. The probability distribution p(x[n]|q[n],z[n]) can be modeled using normal distribution or lognormal distribution.

Considering the volume of the audio signal at the onset time T, the sound with large volume is generally considered to have a high tendency of being a beat than the sound with small volume. This tendency can also be included in P(X|Q,Z) with the volume added to one of the feature quantities, and can be provided to the probabilistic model.

Combining the above two, the tempo is Z=z[1], . . . , z[N] when the beat length is Q=q[1], . . . q[N], and the probability P(X,Z|Q) in which the inter-onset interval (IOI) X is X=x[1], . . . , x[N] is given.

The probability of occurrence can be considered for the pattern q[1], . . . , q[N] of the beat length. For instance, the beat length pattern having high frequency of occurrence, and the beat length pattern that can be written on a musical score but does not appear in reality are considered, where it is natural to think that such patterns can be handled with high and low of the probability of occurrence of the pattern. Therefore, the beat length pattern can be probabilistically modeled by modeling the time series of q by the N-gram model or modeling the probability of occurrence of the template pattern of a predetermined beat length or the template pattern by the N-gram model. The probability of the beat length Q provided by the model is P(Q).

Considering P(Q), the Q function is that in which the log P(Q) is added to the Q function of when the EM algorithm is applied for the likelihood, so that the relevant Q function can be used as an auxiliary function of guiding increase in log of the posteriori probability P(Q|X) in MAP estimation.

The probability distribution P(Z|X,Q) of the tempo Z can be given with the following equation (4) by using the P(X,Z|Q) given by the model. The Q function described above then can be calculated. Therefore, in this case, the Q function is given by the following equation (5).

$$P(Z|X,Q)=\frac{P(X,Z|Q)}{\int P(X,Z'|Q)dZ'} \tag{4}$$

$$G(Q,Q')=\sum_n\int p(z[n]=z|X,Q)\cdot\log p(x[n],z[n]=z|q'[n])dz+\log P(Q')+const. \tag{5}$$

The p(z[n]=z|X,Q) is desirably specifically calculated to calculate Q' which maximizes the Q function of the equation (5). A calculation method (correspond to E step) of the probability distribution of the latent variable (tempo z) will be described below.

The p(z[n]=z|X,Q) necessary for maximizing the Q function is obtained from the following algorithm. This is a method in which a method called "Baum-Welch algorithm" is applied with the HMM (hidden Markov model). The p(z[n]=z|X,Q) can be calculated with the following equation (8) using the forward probability α_n(z) of the following equation (6) and the backward probability β_n(z) of the following equation (7). The forward probability α_n(z) and the backward probability β_n(z) are obtained by an efficient recursive calculation using the following equations (9) and (10). The difference with the "Baum-Welch algorithm" of the HMM is that the present model does not aim to obtain the transition probability and that the latent variable of the present model is a variable that takes a continuous value and not a discrete variable handled as a hidden state.

$$\alpha_n(z)=p(z_n=z|x_1,\ldots,x_n,Q) \quad (6)$$

$$\beta_n(z)=p(z_n=z|x_{n+1},\ldots,x_N,Q) \quad (7)$$

$$p(z_n=z|X,Q)\propto\alpha_n(z)\cdot\beta_n(z) \quad (8)$$

$$\alpha_n(z)=\int\alpha_{n-1}(z')p(z_n=z|z_{n-1}=z')dz'\cdot p(x_n|z,q_n) \quad (9)$$

$$\beta_n(z)=\int p(z_{n+1}=z'|z_n=z)\cdot p(x_{n+1}|z',q_{n+1})\cdot\beta_{n-1}(z')dz' \quad (10)$$

The Q' that maximizes the Q function G(Q,Q') calculated as above is then obtained (correspond to M step). The algorithm used here depends on the P(Q), and can be optimized with the algorithm based on the DP (Dynamic Programming) as in the Viterbi algorithm if based on the Markov model. If the Q' is the Markov model of the template including variable number of beat lengths Q, an appropriate algorithm is selected according to the model that provides P(Q) such as time synchronous Viterbi search or 2-stage dynamic programming. The beat length Q that maximizes the Q function is thereby obtained.

Therefore, if the sequence X of a certain inter-onset interval IOI is given, the Q function or the auxiliary function can be converged by repeating the E step of calculating the forward probability α and the backward probability β and the M step of obtaining the Q that maximizes the Q function based on α and β to obtain the beat length Q (Q=q[1],q[2], . . . , q[M]) corresponding to each onset time T.

Generally, in the EM algorithm, the converged solution depends on the initial value given to start the repetitive calculation, and thus the manner of providing the initial value has an important influence on the performance. The promising clues for giving the initial value can be obtained for the tempo rather than the beat. When the auto-correlation function of the time change (power envelope) of the power of the audio signal is used, the period having a large auto-correlation is assumed to have a high possibility that the relevant period is the tempo, and thus the probability distribution of the tempo reflecting the target relation of the auto-correlation on the magnitude relation of the probability can be used. The EM algorithm is applied using the initial probability distribution $P_0(Z)$ of the tempo as the initial value.

Using the beat length Q (=q[1],q[2], . . . , q[M]) obtained as above, the onset time of the beat is interpolated as desired to obtain the beat based on the beat length Q to obtain the beat performed every one beat or every two beats.

The principle of the beat analyzing method according to the present embodiment has been described above. According to such beat analyzing method, the appropriate beat length Q (=q[1],q[2], . . . , q[M]) at each position of the audio signal and the beat can be obtained even if the tempo Z of the audio signal changes.

Figure 8:
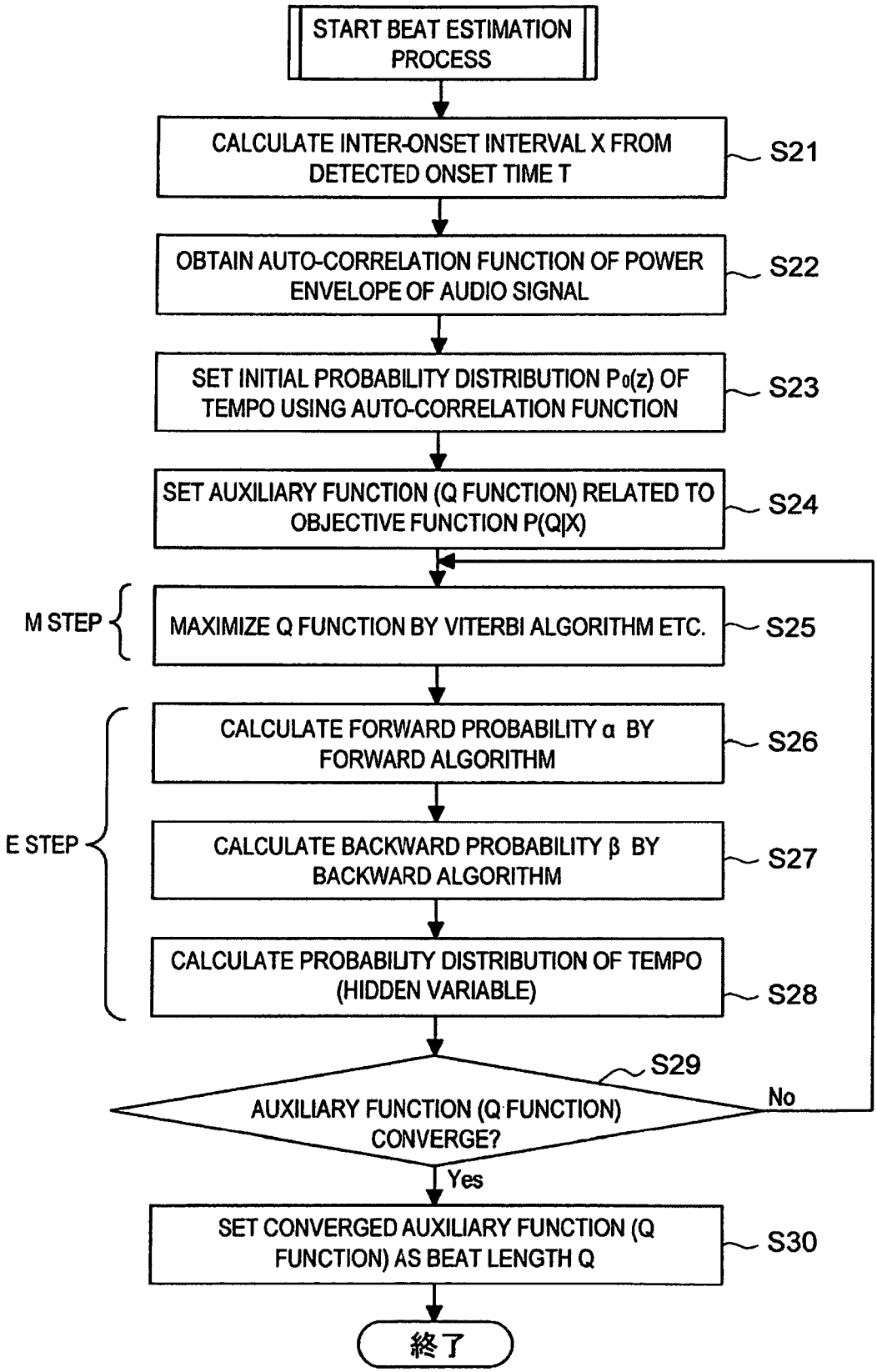
FIG. 8 is a flowchart showing an example of a beat estimation process of FIG. 6.

An example of the beat estimation process (S20 of FIG. 6) using the above beat analysis will now be described in detail with reference to FIG. 8. FIG. 8 is a flowchart showing an example of the beat estimation process S20 of FIG. 6. The beat estimation process S20 can be executed at an arbitrary timing after the onset time detection process (S10).

As shown in FIG. 8, in the onset time detection process S10, the beat length calculation unit 18 of the signal processing device 10 first calculates the interval X of the detected onset time T (step S21). Specifically, the beat length calculation unit 18 reads a plurality of onset times T (=t[1], t[2], . . . , t[N]) detected in the onset time detection process (S10) from the onset time storage unit 14, calculates the difference between the respective onset times t, and obtains the inter-onset interval (IOI) X (=x[1], x[2], . . . , x[N]). For instance, the inter-onset interval x[1] is obtained by subtracting the onset time t[ ] from the onset time t[2].

The tempo probability distribution setting unit 16 obtains the auto-correlation function (see FIG. 5) of the power envelope of the audio signal (step S22). Specifically, the tempo probability distribution setting unit 16 analyzes the power (signal level) of the input audio signal to generate the time change of the power of the audio signal (i.e., power envelope of the audio signal). The generation process of the power envelope is similar to S11 of FIG. 7, and thus detailed description will be omitted. The tempo probability distribution setting unit 16 may not obtain the power envelope and may use the power envelope obtained by the onset time detection unit 12. The tempo probability distribution setting unit 16 then obtains the auto-correlation function of the power envelope of the audio signal.

Furthermore, the tempo probability distribution setting unit 16 uses the auto-correlation function of the power envelope of the audio signal obtained in S22 to calculate the initial probability distribution $P_0(Z)$ of the tempo Z which is the latent variable, and sets $P_0(Z)$ as the initial value of the probability distribution P(Z) of the tempo Z (step S23). As described above, using the fact that the period having high auto-correlation of the power envelope has a high possibility of being the tempo Z, the tempo probability distribution setting unit 16 converts the relevant auto-correlation function to the initial probability distribution $P_0(Z)$ of the tempo Z.

The beat length calculation unit 18 then sets the objective function P(Q|X) and the auxiliary function (Q function) (step S24). The objective function P(Q|X) is the probability the inter-onset interval X corresponds to the beat length Q between the beats of the music when the inter-onset interval X of the music represented by the audio signal is provided. In other words, the objective function P(Q|X) is the probability the onset time T corresponds to the beat of the music when the onset time T of the music is provided. The auxiliary function (Q function) is the function for guiding the update of the beat length Q so as to monotonously increase (monotonously non-decrease) the objective function P(Q|X). Specifically, the auxiliary function (Q function) is the update algorithm of the beat length Q for monotonously increasing (monotonously non-decreasing) the logarithm of the posteriori probability obtained by having the tempo Z as the latent variable and taking the expected value of the latent variable. The auxiliary function (Q function) is derived from the EM algorithm (equation (3)), and can use equation (5) corrected so as to adapt to beat analysis, as described above.

The Q function is expressed with the following equation (11) for the sake of convenience of the explanation. For the probability distribution P(Z) of the tempo Z (latent variable) in the Q function of the equation (11), the initial probability distribution $P_0(Z)$ obtained in S23 is used as the initial value, and thereafter, P(Z|X,Q) obtained in the E steps S26 to S28 of the EM algorithm, to be hereinafter described, is used.

$$G(Q,Q')=\int P(Z)\cdot\log P(X,Z|Q')dZ \quad (1)$$

$$P(Z)=P_0(Z)$$

$$P(Z)=P(Z|X,Q)$$

The beat length calculation unit 18 then updates the beat length Q for guiding the log likelihood log P(X|Q) to a maximum value using the auxiliary function (Q function) by the EM algorithm. The EM algorithm includes the M step S25 for obtaining Q that maximizes the Q function, and the E steps S26 to S28 for estimating the probability distribution P(Z) of the tempo Z and obtaining the Q function.

First, in the M step, the beat length calculation unit 18 maximizes the auxiliary function (Q function) as in the following equation (12) by Viterbi algorithm or 2-step DP (step S25). The beat length Q corresponding to the provided inter-onset interval X can be estimated by obtaining the Q that maximizes the Q function. The drop/insertion of the beat is contained in the beat length Q obtained in this step S until determined that the Q function is converged in S29.

$$\hat{Q} = \arg\max_{Q'} G(Q, Q') = \arg\max_{Q'} \int P(Z) \cdot \log P(X, Z \mid Q') dZ \tag{12}$$

In the E steps S26 to S28, the beat length calculation unit 18 efficiently calculates P(Zt|X,Q) using the forward probability α and the backward probability β, First, the forward probability α shown in equation (13) is calculated by forward algorithm (step S26), and then the backward probability β shown in equation (14) is calculated by backward algorithm (step S27). Thereafter, the beat length calculation unit 18 multiples the forward probability α and the backward probability β as in equation (15), and obtains P(Zt|X,Q).

$$\alpha_n(z)=P(Z_n=z|x_1, \ldots, x_n, Q) \tag{13}$$

$$\beta_n(z)=P(Z_n=z|X_{n+1}, \ldots, x_N, Q) \tag{14}$$

$$p(Z_n=z|X,Q) \propto \alpha_n(z) \cdot \beta_n(z) \tag{15}$$

Subsequently, the beat length calculation unit 18 determines whether or not the Q function is converged (step S29), returns to S25 if not converged, and repeats the EM algorithm until the Q function is converged (S25 to S29). The process proceeds to S30 if the Q function is converged, and sets the converged Q function as the beat length Q (step S30).

The tempo analyzing method according to the present embodiment will now be described. The tempo Z can be calculated using the beat length Q obtained in the beat analyzing process described above, and the inter-onset interval X. The optimum tempo Z can be obtained through the following method according to the purpose.

For instance, when desiring to observe fine fluctuation of the performance, each inter-onset interval X is divided by the beat length Q corresponding thereto to accurately obtain the tempo Z as the time for one beat (Z=X/Q).

Figure 9:
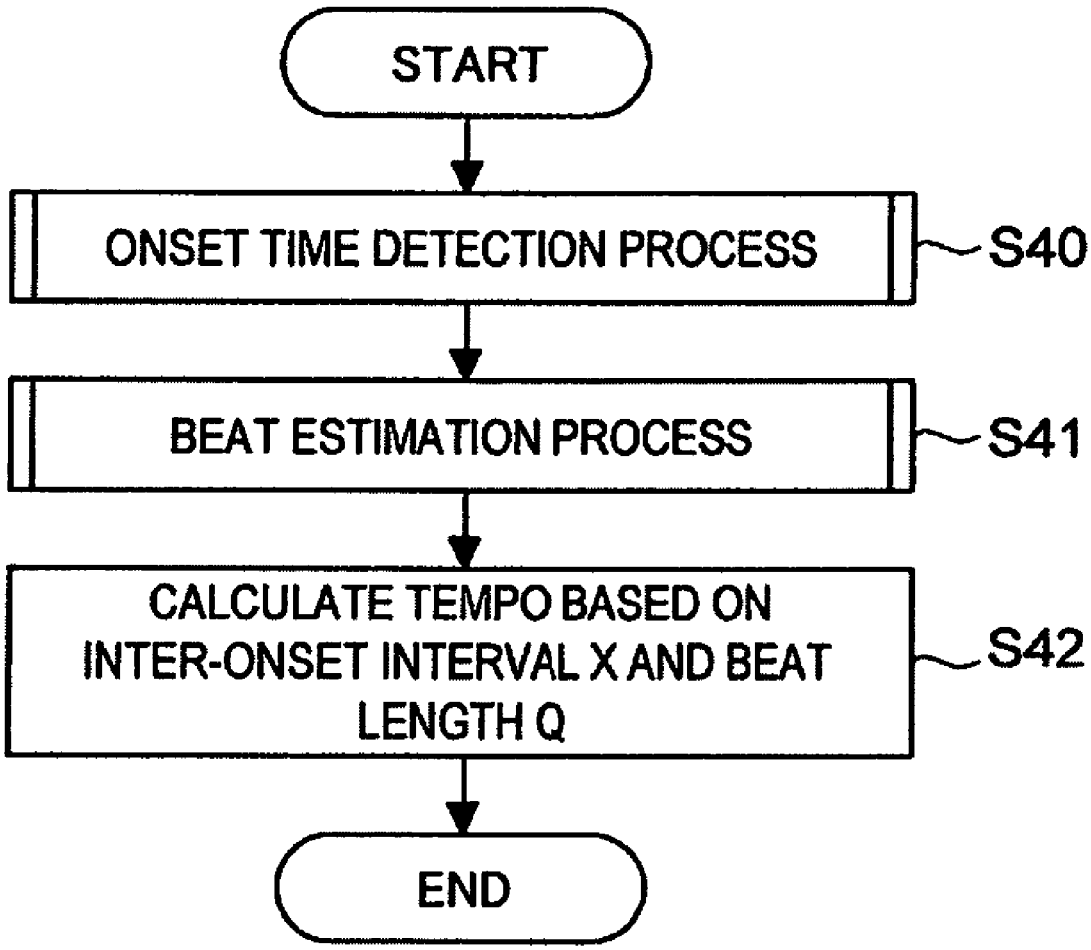
FIG. 9 is a flowchart showing a tempo analyzing method according to the present embodiment.

The tempo analyzing method, which is one example of the signal processing method according to the present embodiment, will be described with reference to FIG. 9. FIG. 9 is a flowchart showing the tempo analyzing method according to the present embodiment.

As shown in FIG. 9, first the onset time detection process is executed (step S40), and then the beat estimation process is executed (step S41). The onset time detection process S40 is similar to the processes S11 to S16 of FIG. 7, and the beat estimation process S41 is similar to the processes S21 to S30 of FIG. 8, and thus the detailed description will be omitted.

Each inter-onset interval X (=x[1], x[2], . . . , x[N]) obtained from the onset time T detected in the onset time detection process S40 is then divided by each beat length Q (=q[1],q[2], . . . , q[N]) obtained in the beat estimation process S41 to obtain each tempo Z (=z[1], z[2], . . . , z[N]) (step S42).

If the tempo Z is obtained on the assumption of the characteristic that the tempo Z modeled by the probabilistic model smoothly fluctuates, the most likely tempo Z in the model can be obtained with the following equation (16). Other than the method of obtaining by smoothing the fluctuation of the tempo Z, the tempo can be obtained through various methods such as minimizing the square error so that the tempo matches a constant value or a template.

$$\hat{Z} = \arg\max_{Z} P(X \mid Z, Q) \cdot P(Z) \tag{16}$$

Figure 10A:
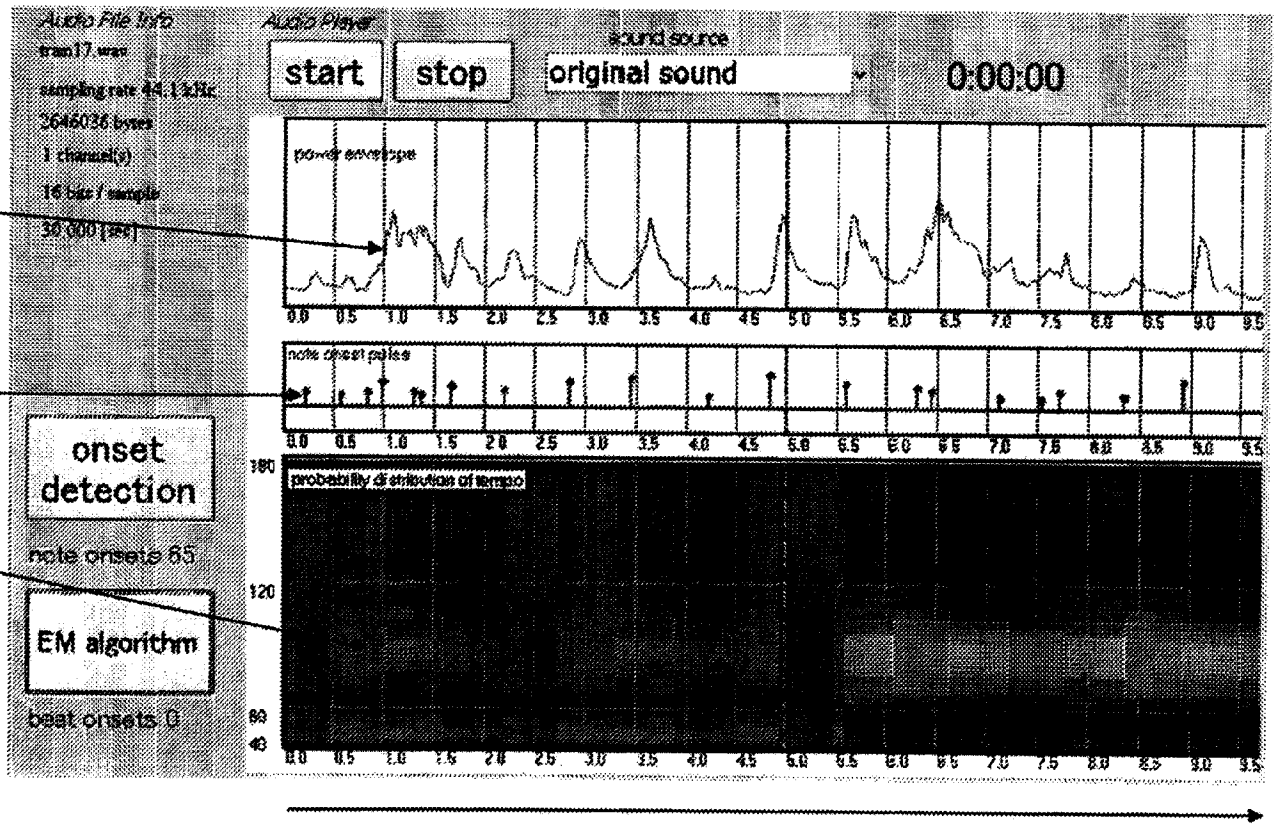
FIG. 10A is a display screen example of after pre-process and before beat analysis by the signal processing device according to the present embodiment.
Figure 10B:
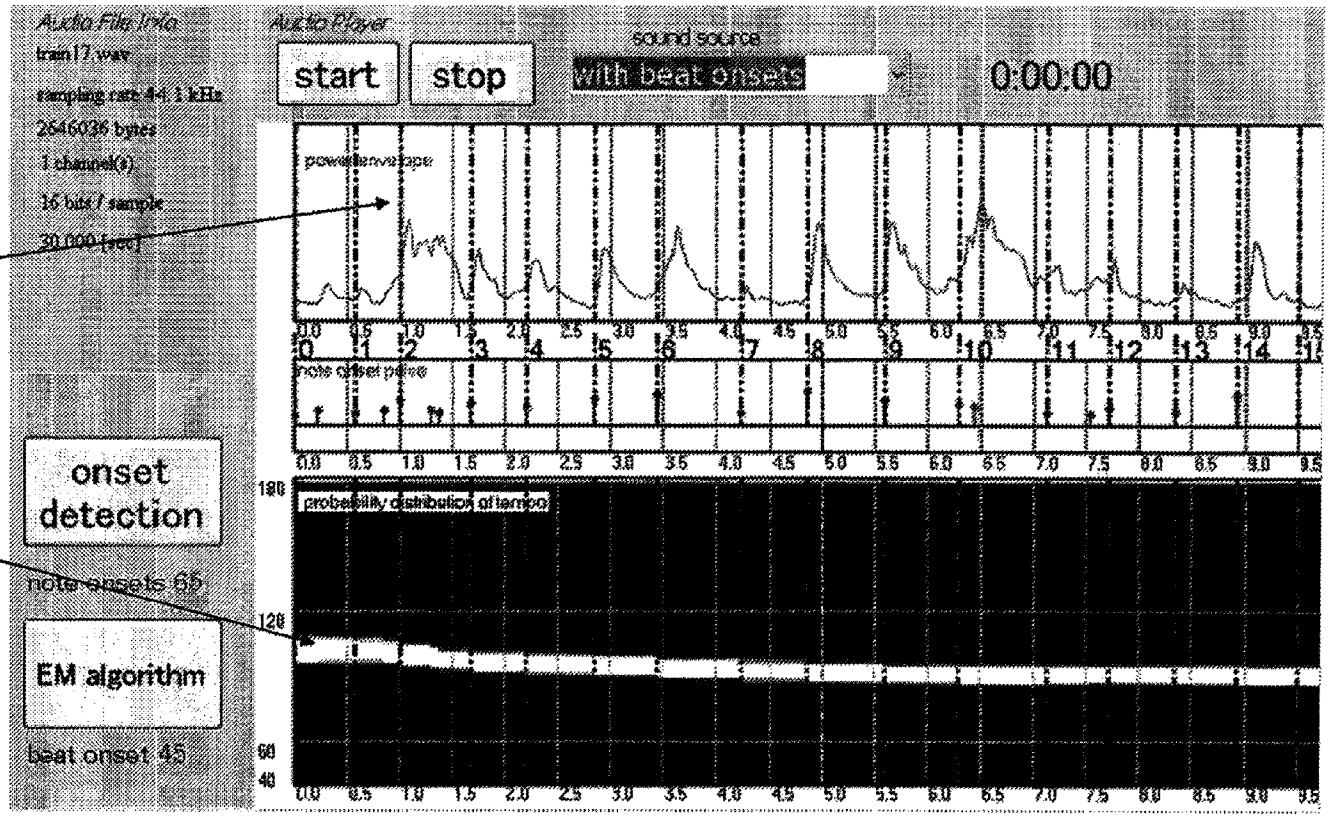
FIG. 10B is a display screen example of after the beat analysis by the signal processing device according to the present embodiment.

Specific examples of the result of analysis of the beat and the tempo by the signal processing method according to the present embodiment will be described with reference to FIG. 10. FIG. 10A shows an example displaying the result of analysis of the beat and the tempo on a display screen of the signal processing device 10 according to the present embodiment. FIG. 10A shows a display screen of after the preprocess (after detection of onset time, before tempo color probability beat analysis) and after the beat analyzing process, and FIG. 10B shows a display screen of after the beat analysis.

As shown in FIG. 10A, the display screen of before the beat analysis displays the power envelope of the audio signal, the onset time X detected from the power envelope, and the initial probability distribution of the tempo Z obtained from the auto-correlation of the power envelope. At the stage of FIG. 10A of before the beat analysis, the position of the beat is not displayed, and the probability distribution of the tempo is not very definite (high and low of probability is expressed with the contrast in the vertical axis direction, white portion has higher probability than black portion).

On the display screen after the beat analysis, the position of the beat estimated by the beat analysis is displayed with a chain double dashed line. The estimated beat matches the onset time X of one part corresponding to the beat of the music of a plurality of onset times X. With regards to the probability distribution of the estimated tempo, the white portion having a high probability is clearly displayed in a band shape, compared to FIG. 10A. Furthermore, the tempo gradually lowers with elapse of time, and the change in tempo in a few seconds can be accurately acquired. Even if the tempo of the audio signal is changed, the beat can be appropriately estimated following the change in tempo.

As described above, in the beat analyzing method according to the present embodiment, the most likely beat is obtained for the detected onset time T and the beat is probabilistically estimated to obtain the beat from the music represented by the audio signal. That is, when the inter-onset interval X of the music is given, the objective function P(Q|X) representing the probability of being the beat length Q between the beats of the music and the auxiliary function for guiding the update of the beat length Q for monotonously increasing the objective function P(Q|X) are set. The update of guiding the log likelihood log P(X|Q) to a maximum value using the auxiliary function is repeated to obtain a beat that maximizes the objective function. The beat of the music then can be accurately obtained.

The initial probability distribution of the tempo Z obtained from the auto-correlation function of the power envelope of the audio signal is applied as the initial value of the probability distribution of the tempo Z contained in the Q function, and thus robust beat estimation can be performed.

Furthermore, even if the tempo of the music is changed such as the tempo gradually becomes faster/slower in one music (e.g., one musical composition), a suitable beat can be obtained following the change of the tempo.

The beat and the tempo are basic feature quantities of the music, and the beat and tempo analyzing method according to the present embodiment is useful in various applications described below.

(Provision of Metadata of Music)

If great amount of musical content data (musical composition) is present, it is a very troublesome task to label all the tempos of such musical composition. In particular, since the tempo generally changes in the middle of the song, great effort is desired to label the tempo by beat or by bar, and it is not realistically possible. In the present embodiment, the tempo for every musical composition and the tempo that changes in the musical composition are automatically obtained, and added to the musical content as metadata, and thus the effort can be alleviated.

(Music Search)

Application can be made to the search of the musical content with the tempo or the beat obtained from the beat analysis as query such as "music of fast tempo", "music of eight beat" and the like.

(Music Recommendation)

Application can also be made to recommend favorite songs to listeners. For instance, the tempo is used as an important feature quantity of the music when making a playlist that matches the preference of the user.

(Organization of Musical Compositions)

In addition, the similarity of musical compositions can be calculated based on the tempo. The information of tempo and beat are desirably obtained to automatically categorize great amount of musical compositions owned by the user.

(Synchronization with Dance)

Program can be created to cause the robot and the like to dance with the beat of the music by knowing the beat of the music. For instance, robots having music reproduction function is being developed, where such robot automatically performs song analysis while reproducing the music and creates motion and reproduces the music while moving (motion reproduction). In order to cause such robot to dance with the beat of the music, the beat of the music is detected, and software containing the beat detection function is actually being distributed. The beat analyzing method according to the present embodiment can be expected to further strengthen the beat detection used in such scenes.

(Synchronization with Slide Show of Pictures)

In the slide show presenting pictures with music, there is a demand to match the timing to switch the pictures with the timing to switch the music. According to the beat analysis of the present embodiment, the onset time of the beat can be provided as a candidate of the timing to switch the pictures.

(Automatic Scoring)

The basic elements described in the musical score are the pitch (height of note) and the beat (length of note), and thus the music can be converted to a musical score by combining the pitch extraction and the beat estimation according to the present embodiment.

(Music Analysis)

As in code analysis of the music analyzing technique, features of various music can be analyzed with the beat as the trigger of the audio signal (music/sound signal). For instance, the pitch extraction and the features such as tone are analyzed with the beat estimated in the present embodiment as a unit, and the structure of the musical composition including refrain and repetitive patters can be analyzed.

It should be understood by those skilled in the art that various modifications, combinations, sub-combinations and alterations may occur depending on design requirements and other factors insofar as they are within the scope of the appended claims or the equivalents thereof.

In the embodiment described above, an example of applying the EM algorithm using the probabilistic model has been described, but the present invention is not limited to the example of such probabilistic model. For instance, application similar to the embodiment can be made as long as the auxiliary function (correspond to Q function) for monotonously increasing (or monotonously decreasing) the objective function based on the parameter (correspond to probability) for normalizing the cost similar to probability, and the convexity (correspond to logarithm function) of the objective function (correspond to posteriori probability) set for the relevant model can be derived.

What is claimed is:

1. A signal processing device for processing an audio signal, comprising:

an onset time detection unit for detecting an onset time based on a level of the audio signal; and a beat length calculation unit for obtaining a beat length Q by:

setting an objective function P(Q|X) and an auxiliary function, the objective function P(Q|X) representing a probability that, when an interval X between the onset times is given, the interval X is the beat length Q, the auxiliary function being for inducing an update of both the beat length Q and a tempo Z that results in a monotonous increase of the objective function P(Q|X); and repeating maximization of the auxiliary function to have the auxiliary function converge.

2. The signal processing device according to claim 1, wherein the auxiliary function is set based on an update algorithm of the beat length Q, in which the tempo Z of the audio signal is set as a latent variable, and a logarithm of a posterior probability P(Q|X) is increased monotonously, the posterior probability P(Q|X) being obtained by obtaining an expectation of the latent variable.

3. The signal processing device according to claim 1, wherein the beat length calculation unit derives the auxiliary function from an EM algorithm.

4. The signal processing device according to claim 1, wherein the beat length calculation unit obtains an initial probability distribution of the tempo Z of the audio signal based on an auto-correlation function of a temporal change of a power of the audio signal, and uses the initial probability distribution of the tempo Z as an initial value of a probability distribution of the tempo Z contained in the auxiliary function.

5. The signal processing device according to claim 1, further comprising a tempo calculation unit for obtaining the tempo Z of the audio signal based on the beat length Q obtained by the beat length calculation unit and the interval X.

6. A signal processing method for processing an audio signal, comprising the steps of:

detecting an onset time based on a level of the audio signal; and obtaining a beat length Q by:

setting an objective function P(Q|X) and an auxiliary function, the objective function P(Q|X) representing a probability that, when an interval X between the onset times is given, the interval X is the beat length Q the auxiliary function being for inducing an update of both the beat length Q and a tempo Z that results in a monotonous increase of the objective function P(Q|X); and repeating maximization of the auxiliary function to have the auxiliary function converge.

7. A program for causing a computer to execute the steps of:

detecting an onset time based on a level of the audio signal; and obtaining a beat length Q by:

setting an objective function P(Q|X) and an auxiliary function, the objective function P(Q|X) representing a probability that, when an interval X between the onset times is given, the interval X is the beat length Q, the auxiliary function being for inducing an update of both the beat length Q and a tempo Z that results in a monotonous increase of the objective function P(Q|X); and repeating maximization of the auxiliary function to have the auxiliary function converge.

* * * * *